US005540599A

United States Patent [19]

Bishop

[11] Patent Number: 5,540,599

[45] Date of Patent: Jul. 30, 1996

[54] ELECTRICAL CONNECTOR

[75] Inventor: Peter G. Bishop, Isleham, United Kingdom

[73] Assignee: Elco Europe Limited, United Kingdom

[21] Appl. No.: 257,088

[22] Filed: Jun. 9, 1994

[51] Int. Cl.[6] ..... H01R 13/24

[52] U.S. Cl. ..... 439/289; 439/700

[58] Field of Search ..... 439/289, 700, 439/824

[56] References Cited

U.S. PATENT DOCUMENTS

| | | | |
|---|---|---|---|
| 2,615,951 | 10/1952 | Klostermann | 439/289 |
| 4,431,242 | 2/1984 | Gisewsky | 439/289 |

FOREIGN PATENT DOCUMENTS

| | | |
|---|---|---|
| 256541 | 8/1987 | European Pat. Off. . |
| 1347283 | 12/1962 | France . |

OTHER PUBLICATIONS

Patent Abstract, Japan, JP 3263772, Kokusai Electric Co. Ltd. Nov. 1991.

*Primary Examiner*—Neil Abrams

*Attorney, Agent, or Firm*—Iandiorio & Teska

[57] ABSTRACT

A two-part electrical connector is provided with contact elements having butting contacting surfaces for making electrical contact between the two parts. In one of the two parts, at least one of the elements has a contacting surface which is laterally displaceable relative to a principal axis of the contact element and which may also be axially displaceable along the same principal axis of the contact element. In the the other of the two parts, at least one of the elements has a contacting surface angled to a principal axis of the contact element. A wiping action is thereby provided between the respective contacting surfaces of the two contact elements when the two parts of the connector engage. The connector may be employed with mobile or portable equipment, where the first part of the connector is associated with other equipment, and the other part of the connector is mounted upon the mobile or portable equipment. (FIGS. 4 & 8)

8 Claims, 3 Drawing Sheets

ELECTRICAL CONNECTOR

The present invention relates to electrical connectors and more particularly to two-part electrical connectors for use with mobile or portable equipment.

The need to make occasional electrical connection to otherwise self-contained mobile or portable equipment, for example to incorporate the equipment in a larger equipment, to enable batteries within the equipment to be periodically charged, or to enable external testing of the equipment, calls for a connector upon the body of the equipment which does not interfere with the normal handling and use of the equipment, and which may be sealed to prevent the ingress of dirt or wet into the interior of the equipment. At the same time such a connector must be able to make ready and reliable contact with a complementary connector associated with other equipment, even though such a requirement may be infrequent.

According to one aspect of the invention a two-part electrical connector includes a first part comprising a first contact element having a contacting surface adapted to make butting contact with a contacting surface of a second contact element comprised in the second part, the contacting surface of the first contact element being capable of lateral movement relative to a principal axis of the first contact element, and the contacting surface of the second contact element being angled relative to a principal axis of the second contact element, such that when the respective contacting surfaces of the first and second contact elements make butting contact, at least part of the contacting surface of the first contact element is displaced across at least part of the contacting surface of the second contact element, thereby providing a surface wiping action in order to clean one or both of the contacting surfaces.

At least one of the two contact elements may be capable of axial displacement along its principal axis thereby to provide a positive engagement pressure between the two contacting surfaces.

The invention provides a two-part electrical connector particularly appropriate for irregular use, where the second part is mounted upon mobile or portable equipment, and the connection to it of the first part causes the contacting surfaces to be wiped together in a cleaning action, to ensure a more certain electrical contact than might otherwise be the case.

These and other aspects of the invention will be described with reference to the specific embodiment shown in the accompanying drawings of which:

Figure 1:
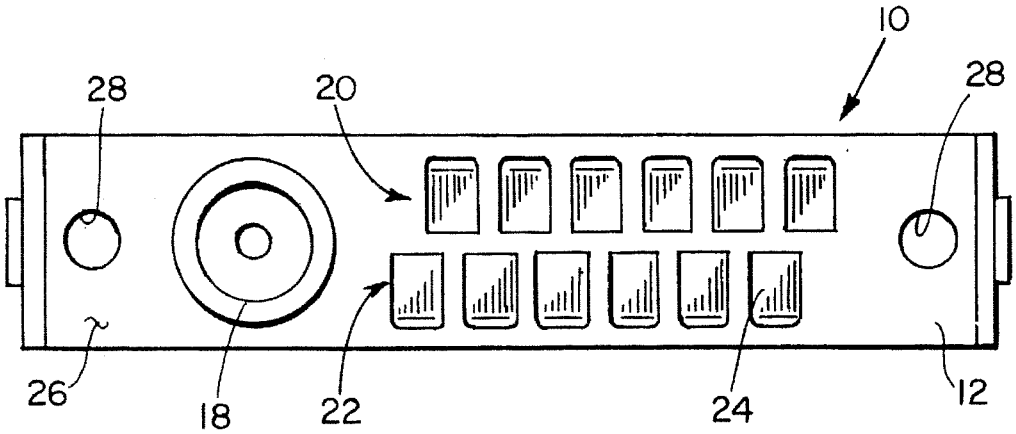
FIGS. 1, 2 and 3 show, respectively, the plan views from above and below and the side elevation of one part of a two-part connector in accordance with the invention.
Figure 2:
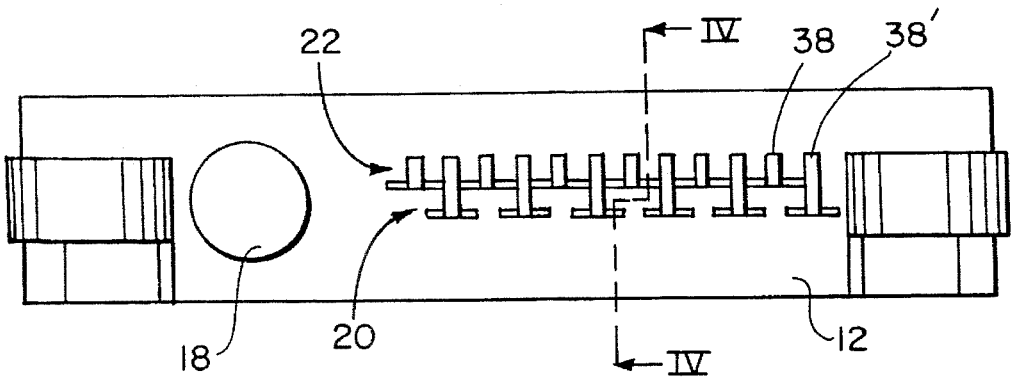
Figure 3:
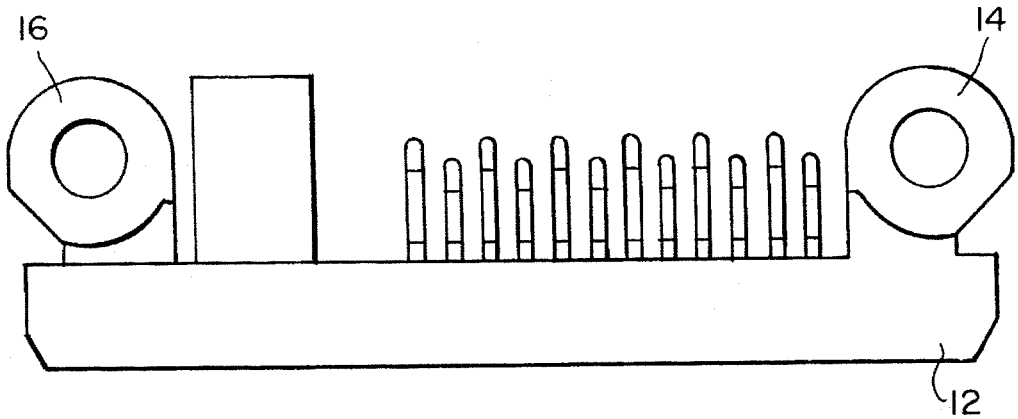

Referring to FIGS. 1 to 4 of the drawings, a fixed socket connector 10 comprises a moulded electrically insulating housing 12, which has apertured mounting ears 14, 16, and carries a fixed coaxial connector socket 18 and two parallel rows 20 and 22 of electrical contacts 24.

The outer face 26 of housing 12 also has two alignment apertures 28, one adjacent each end.

Housing 12 is adapted to be mounted through the casing of an equipment, for example the handset of a mobile telephone, with face 26 flush with the surface of the equipment casing.

Figure 4:
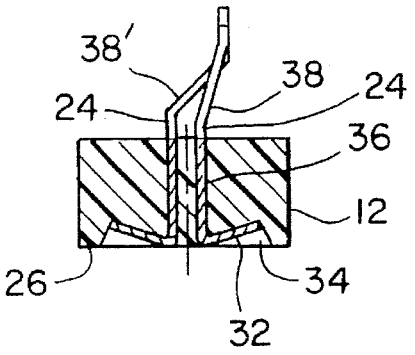
FIG. 4 shows a section through the part of FIGS. 1–3 taken on the line IV—IV, looking in the direction of the arrows.
Figure 5:
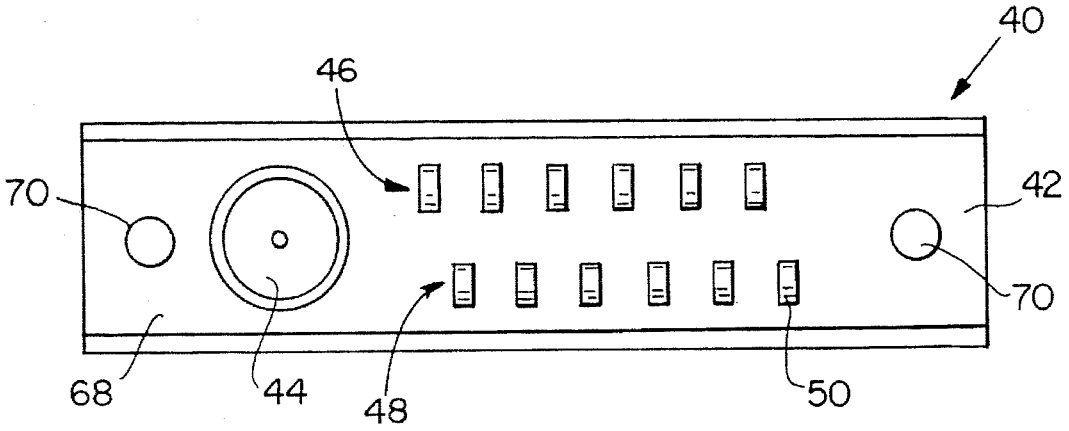
FIGS. 5, 6 and 7 show respectively the plan views from above and below, and the elevation of the other part of a two-part connector in accordance with the invention.
Figure 6:
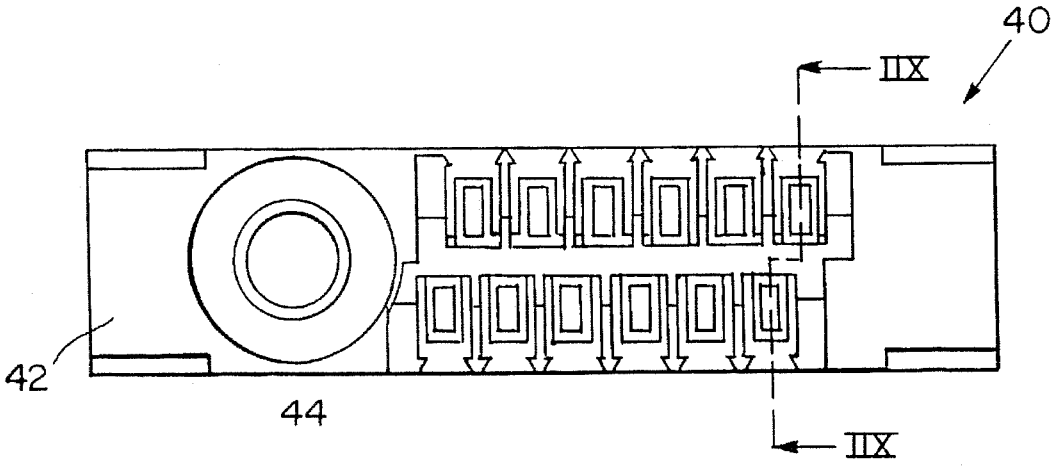
Figure 7:
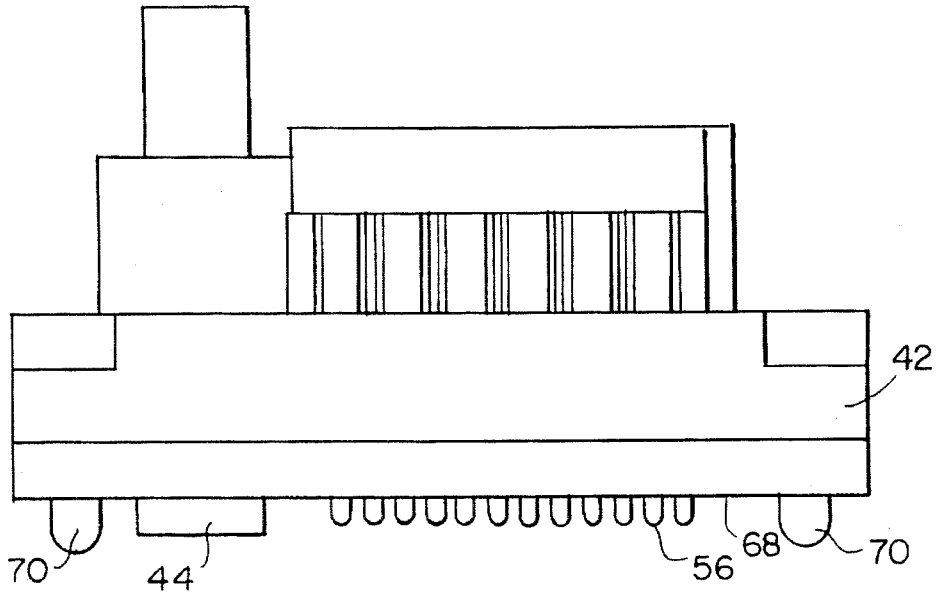

The electrical contacts 24 are generally J-shaped and a pair of them, one from each of the two rows 20 and 22, are shown in detail in FIG. 4.

Each contact comprises a substantially flat contact surface 32 seated within an aperture 34 in face 26 of housing 12 to lie slightly below face 26, a stem portion 36 which passes as an interference fit through the body of housing 12, and a termination portion 38.

The contact surface 32 of each contact is angled to the principal longitudinal axis of the stem portion 36 as shown, lying against the complementarily angled lower face of aperture 34.

In the present embodiment the termination portions 38, 38' of the two contacts 24 shown in FIG. 4 are shaped to align with each other in a common plane such that both may be surface mounted, together with all the other termination portions of contacts 24 in rows 20 and 24, on to the face of a printed circuit board.

Other configurations may also be adopted for termination portions 38, appropriate to the equipment with which the fixed connector 10 is to be used.

The individual contacts 24 in rows 20 and 22 are staggered as shown so that their termination portions 38 may lie alternately side-by-side with one another in the common connection plane, as shown.

Referring to FIGS. 6 to 9, the connector 40, complementary to the fixed connector 10 of FIGS. 1 to 5, comprises an apertured moulded body member 42 which carries a coaxial connector 44 and two spaced-apart rows 46 and 48 of sprung contact elements 50. The contact elements 50 comprising row 46 are staggered from those comprising row 48.

Figure 8:
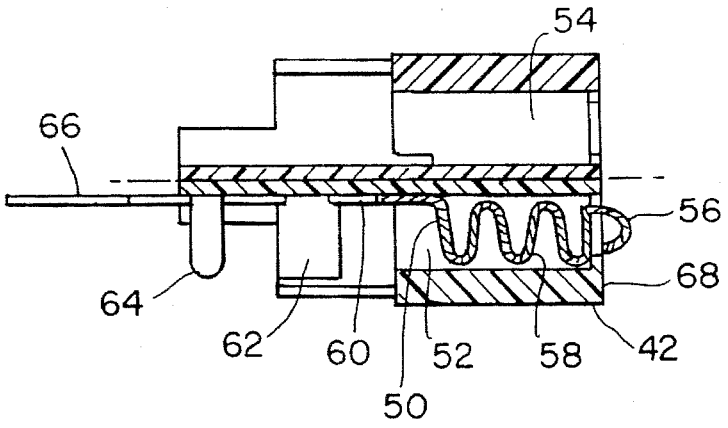
FIG. 8 shows a section through the part of FIGS. 5–7 taken on the line IIX—IIX, looking in the direction of the arrows.
Figure 9:
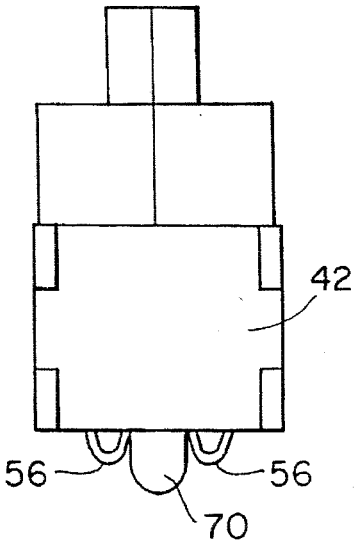
FIG. 9 shows the end elevation of the part shown in FIGS. 5–7.

FIG. 8 shows one contact element 50 and the manner of its mounting in body member 42. For clarity, contact element 50 has been omitted from the upper of the two mounting apertures 52, 54 in body member 42.

Each contact element 50 consists of a single strip of phosphor bronze formed to provide a v-shaped contacting surface 56, a serpentine centre section 58, and an extended tail section 60 to which are attached locating members 62 and 64, and which provides a terminating section 66.

Contact elements 50 are located in apertures such as 52 by means of the integral locating members 62 and 64 which ensure that contacting surface 56 protrudes from aperture 52, proud of the surface 68 of housing 42. The portion of contact element 50 comprising contacting surface 56 is a clearance fit in the opening of aperture 52 in surface 68, such as to allow both axial movement, due to the presence of serpentine section 58, and lateral movement of contacting surface 56.

In use, connector 40 is assembled with the complementary fixed connector 10, bringing the points of contacting surfaces 56 of connector 40 into butting engagement with the connecting surfaces 32 of fixed connector 10 such that locating pegs 70 upon surface 68 engage in alignment holes 28, coaxial plug 44 engages coaxial socket 18, and the two rows of contacts 46 and 48 engage the two rows of contacts 20 and 22 respectively.

Upon initial engagement, the point of contacting surface 56 of each contact 50 contacts the most forward portion of the surface 32 of each opposed contact 24, and as full engagement of the two parts of the connector occurs, contact surface 56 is displaced both axially into the opening of aperture 52 and laterally across the surface 32 to the extent permitted by the dimensions of the opening of aperture 52. The lateral displacement provides a sliding action between the point of contacting surface 58, cleaning the area of contact in order to produce a more certain electrical connection between the two. This is of particular advantage where the faces 32 of the fixed contacts 24 may have become dirty or corroded whilst the equipment in which connector 10 is incorporated has been in use.

Axial displacement of contacting surface 56 in the direction of the principal axis of the contact element 50, against the force exerted by the serpentine section 58 of element 50 ensures a positive contact pressure between the contact point of surface 56 and the contacting surface 32 of each of the contact elements 24.

A two-part connector as described above has been shown to provide high reliability in use and has in life tests been shown to provide in excess of 30,000 operations without failure.

It will be apparent that modifications may be made to the embodiments described without exceeding the scope of the invention.

For example, the contact elements may be in a form other than as shown, so long as lateral wiping displacement between their contacting surfaces is permissible. For example the contact 50 may be constructed of three discrete portions: termination, a central sprung section, and contact element, provided the three are electrically unitary.

The contacting surface of each fixed contact element 24 may have other formats so long as a contact face angled to the principal longitudinal axis of the contact element is provided to permit the wiping action described with reference to the connector of the specific embodiment.

Specific termination types have been described for both the fixed and mobile connectors but other types may be employed.

Similarly other combinations of coaxial and signal contacts can be adopted.

I claim:

1. A two-part electrical connector, one part comprising a first contact element fabricated of a conductive strip material and having an integral contact surface formed in the broad dimension of the strip, and the other part comprising a second contact element fabricated of a conductive strip material and having an integral contacting surface formed in the broad dimension of the strip, the contacting surface of the first contact element adapted to make butting contact with the contacting surface of the second contact element when the two parts of the connector are assembled together, the contacting surface of the first contact element being capable of lateral movement relative to a principal axis of the first contact element, and the contacting surface of the second contact element being angled relative to a principal axis of the second contact element, such that when the respective contacting surfaces of the first and the second contact elements make butting contact, the contacting surface of the first contact element is displaced at least partly across the contacting surface of the second contact element, thereby providing a surface wiping action in order to clean one or both of the contacting surfaces.

2. A two-part electrical connector in accordance with claim 1 in which at least one of the two contact elements is axially displaceable along its principal axis, thereby to provide a positive engagement pressure between the two contacting surfaces.

3. A two-part electrical connector in accordance with claim 2 in which the first contact element is axially displaceable.

4. A two-part electrical connector in accordance with claim 3 in which the axial displacement is provided by a resilient section integrally formed as part of the first contact element.

5. A two-part electrical connector in accordance with claim 4 in which the resilient section is serpentine.

6. A two-part electrical connector in accordance with claim 4 in whch the surface contacting surface and the resilient section of the first contact element are directly adjoined.

7. A two-part electrical connector in accordance with claim 1 in which the contacting surface of the second contact element is arranged at an angle of less than 90 degrees to the principal axis of the second contact element.

8. A two-part electrical connector in accordance with claim 1 in which the contacting surface of the second contacting surface lies within a recess in the body of the other part.

* * * * *